US006854981B2

(12) United States Patent
Nelson

(10) Patent No.: US 6,854,981 B2
(45) Date of Patent: Feb. 15, 2005

(54) SMALL PIN CONNECTERS

(75) Inventor: John E. Nelson, Brooklyn Park, MN (US)

(73) Assignee: JohnsTech International Corporation, Minneapolis, MN (US)

( * ) Notice: Subject to any disclaimer, the term of this patent is extended or adjusted under 35 U.S.C. 154(b) by 0 days.

(21) Appl. No.: 10/453,461

(22) Filed: Jun. 3, 2003

(65) Prior Publication Data

US 2004/0033705 A1 Feb. 19, 2004

Related U.S. Application Data

(60) Provisional application No. 60/385,724, filed on Jun. 3, 2002.

(51) Int. Cl.[7] ..... H01R 12/00
(52) U.S. Cl. ..... 439/66; 439/74; 439/591
(58) Field of Search ..... 439/66, 70–74, 439/591

(56) References Cited

U.S. PATENT DOCUMENTS

| | | | | |
|---|---|---|---|---|
| 5,069,629 A | | 12/1991 | Johnson | 439/71 |
| 5,207,584 A | | 5/1993 | Johnson | 439/66 |
| 5,388,996 A | | 2/1995 | Johnson | 439/65 |
| 5,594,355 A | | 1/1997 | Ludwig | 324/755 |
| 5,634,801 A | | 6/1997 | Johnson | 439/71 |
| 5,749,738 A | * | 5/1998 | Johnson et al. | 439/66 |
| 6,019,612 A | | 2/2000 | Hasegawa et al. | 439/73 |
| 6,231,353 B1 | * | 5/2001 | Rathburn | 439/66 |
| 6,244,874 B1 | * | 6/2001 | Tan | 439/66 |
| 6,572,388 B2 | * | 6/2003 | Lee | 439/71 |

* cited by examiner

*Primary Examiner*—Truc T. T. Nguyen
(74) *Attorney, Agent, or Firm*—Nawrocki, Rooney & Sivertson, P.A.

(57) ABSTRACT

An assembly contained within a housing slideably connects device leads to apparatus terminals with predetermined forces. Parallel slots through the housing contain "S" shaped rotatable contacts. The connection force is obtained by compressing two elastomeric members extending through holes perpendicular to the slots and opposite to the contact ends by rotating the contacts. The leads and terminals are opposite and parallel to opposite ends of the contacts, and their connection is provided by this contact rotation. The contact rotations are provided by the nose ends of the contacts extending outward slightly from the slots such that, when the device under test is pressed against the housing, the contacts will be forced within the housing to rotate the contacts and compress the elastomeric members. This provides both a sliding and predetermined force electrical connection between the leads, terminals and contacts.

6 Claims, 3 Drawing Sheets

SMALL PIN CONNECTERS

CROSS-REFERENCE TO RELATED APPLICATIONS

This is a regular application filed under 35 U.S.C. §111(a) claiming priority, under 35 U.S.C. §119(e) (1), of provisional application Ser. No. 60/385,724, previously filed Jun. 3, 2002, under 35 U.S.C. §111(b).

BACKGROUND OF THE INVENTION

1. Field of the Invention

The present invention relates to connector apparatus. More particularly the present invention provides a simple temporary electrical connection arranged to ensure a positive connection having the predetermined force required for the very small connectors used in current test apparatus.

2. Description of the Related Art

Many different arrangements have been provided for quickly and temporarily connecting circuit elements of one device to another. Automated testing apparatus in particular uses a number of such arrangements. One such arrangement is to use the force of bringing a first device against a second device to deform a probe tip mounted on the first device and contact a circuit on the second device. Another arrangement is to use the connection force to rotate a probe within a slot with the rotation being opposed by an elastomeric element in the first device to automatically engage an external circuit in the second device when the devices are brought together. Another arrangement is to use slots with transverse elastomers removably mounted in slots which are hooked by contacts. Bringing the devices together results in the contacts being placed in tension to provide an electrical connection between them with a predetermined force.

While the latter apparatus provides a means of providing a connection between device leads of a device to terminal of test apparatus there are still problems in reducing the connection force to the small amounts required by the currently used extremely small connectors. It would be desirable if a predetermined connection force could be retained but reduced in amount for the latest very small connectors.

SUMMARY OF THE INVENTION

The present invention uses an assembly mounted within a housing to electrically interconnect one or more lead(s) of an integrated circuit device to opposed test apparatus terminals(s). The assembly includes parallel slots, each of which contains a contact, that first provides a wiping connection between the contact and opposed device leads and test terminals, and then provides a predetermined connection force between them. The essence of this invention is providing the predetermined connection force by elastomeric compression. This permits providing a predetermined connection force to the desired amount by selecting appropriate apparatus dimensions and elastomeric members.

The housing has at least one pair of opposed parallel and essentially planar sides. Parallel slots extend between the sides which contain pivotable and "S" shaped contacts. The device leads and test apparatus terminals are each located on the surface of planar faces in the respective apparatus. These planar faces are positioned opposite to opposite the parallel sides of the housing such that their planar surfaces parallel to opposite housing sides with the lead and terminal pairs each directly opposite a contact. The planar face of the device is initially positioned spaced a slight distance from the housing, and the planar face of the apparatus is initially positioned against the housing with the leads near one end of the slot and the terminals near the opposite end. Locating the leads and terminals on opposite sides of a slot provides an electrical connection between the two by rotating the interposed contact.

Cylindrical shaped front and back holes oriented at right angles to the slots extend through both slots and the housing. The holes are offset from each other with the front hole positioned opposite the device leads, and the back hole positioned opposite the test apparatus terminals. The front hole is larger than the back hole, is closer to the surface opposite the leads, and contains a mating cylindrical shaped first elastomeric member which fills the hole. The back hole is closer to the surface opposite the terminals, and contains a mating cylindrical shaped second elastomeric member which fills the hole. The contacts are "S" shaped having oppositely inward curved ends. The contacts are sized such that is located within the adjacent inward curved portion of the contacts, and such that the curved portion of the contact essentially matches the adjacent circumference of the elastomeric member. With this arrangement the elastomeric members within each hole tend to force the respective adjacent contact ends outwardly from the slot.

The first hole and elastomeric member are made larger because the nose end of the contact does not initially contact the device leads since the surface containing the leads is not positioned against the housing. This is in contrast to the terminals which are initially positioned against the planar surface of the housing. The larger nose end permits the nose end to extend further outward from the slot to engage the device leads. This is important because the device and its leads are moved against the planar surface of the housing for testing, and the larger nose size provides the required additional length to reach the spaced apart leads.

Both the front hole and back hole have am optional communication channel interconnecting each hole, which have parallel sides with a width less than that of the interconnected hole diameter. These channels both extend outward from their respective hole perpendicular to the planar surface adjacent to the terminals. These communication holes, together with the holes enclosing the elastomeric members, form an essentially "lollipop" shaped cross-section. These channels permit compressing and forcing the elastomeric members perpendicularly through the communication holes into their respective circular hole when assembling the apparatus, where the elastomeric members will then expand to fill their respective hole, which will secure them in place within the holes. If the channels are not provided then the elastomeric members can be forced into the holes from one end, but this procedure is more difficult.

Another important feature of the present invention is the use of an alignment plate having opposed parallel and planar sides which serves as an end stop to prevent the contact from exiting the slot. The device has a linear edge extending perpendicularly between planar opposed surfaces with its leads located in the planar surface perpendicular to the linear edge. The device is positioned opposite the planar surface of the housing such that the leads are parallel to the contacts and essentially opposite the nose ends.

An alignment plate has at least one planar surface with a linear edge perpendicular to the planar surface. The plate is positioned over the housing face opposite the device with the linear edge of the plate adjacent and parallel to the linear edge of the device. This alignment plate aligns the edge of the device containing the leads with the device leads parallel to the slots, and also locates the device leads opposite the nose end of the contacts. The inner edge of the alignment plate facing the device is beveled. This beveled portion engages and limits the outward excursion of the contact nose to a desired predetermined distance to prevent the contact from exiting the slot. Apparatus known in the art is used to locate the device with each device lead opposite and spaced at a slight distance from a contact with the device oriented and positioned as described above. The apparatus is then used to move the device perpendicular to the contacts until the device has rotated the nose end of the contacts within the housing surface.

With the above arrangement, the front elastomeric member will bear against the inner "hook" side of nose end of the contacts, and the back elastomeric member will bear against the inner "hook" side of the tail end. This will result in the front elastomeric members urging the nose ends of the contacts outward toward the device leads, and the back elastomeric members urging the tail ends of the contacts outward against the test apparatus terminals, then when the apparatus surface containing the leads are pressed against the housing, the nose end of the contact will be forced within the housing. This will rotate the contact and compress both elastomeric members. The elastomeric members each will provide a predetermined and different contact force, because of their different size, against the leads and terminals.

Yet another feature of this invention is that the outermost tail end portion of the contact, before the contact is rotated and the elastomeric members compressed, has a flat portion that is parallel to the terminals. This parallel orientation tends to shift the pivot point of the contact in the direction of the tail end of the contact when it is rotated during connection to ensure that the contact cannot move toward the device and lift out of the slot. dr

BRIEF DESCRIPTION OF THE DRAWINGS

The objects and features of the present invention will become more manifest to those skilled in the art upon a reading of the following descriptions, taken in conjunction with the accompanying drawings where like numerals refer to the same part or feature and wherein.

DETAILED DESCRIPTION OF THE INVENTION

Figure 1:
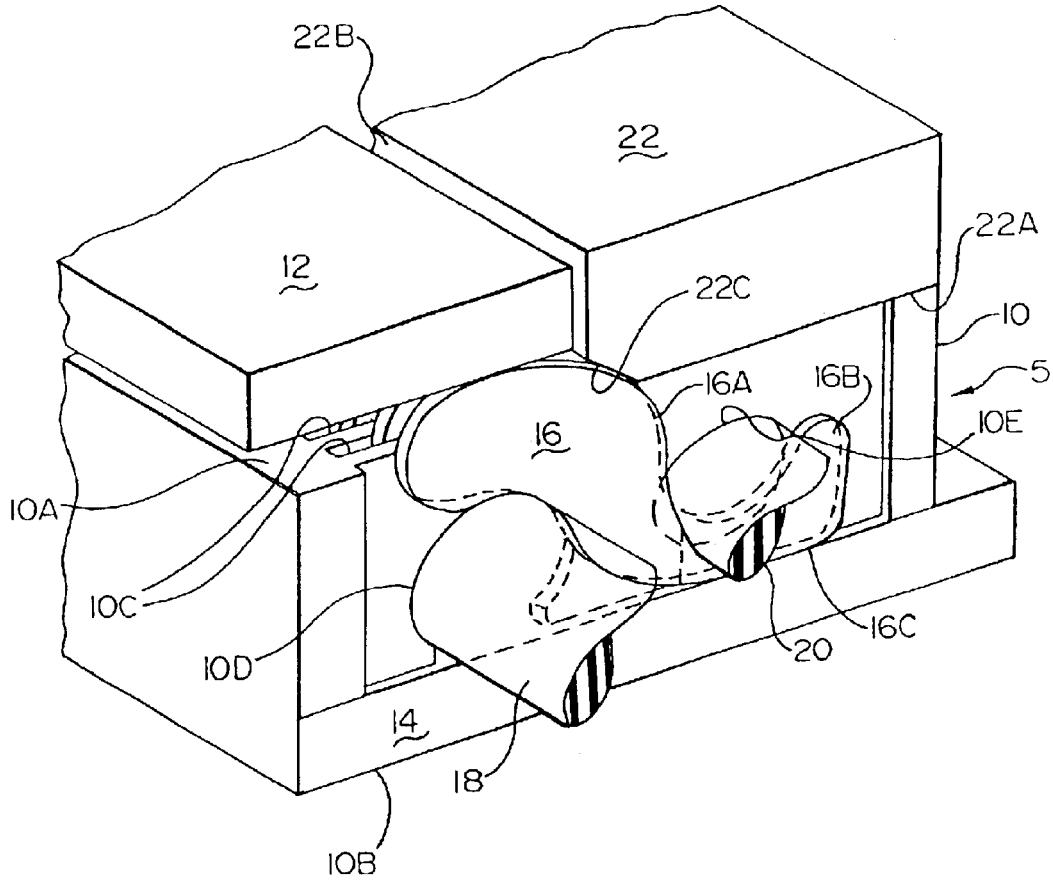
FIG. 1 is a perspective view of a portion of the device, test apparatus and housing.
Figure 2:
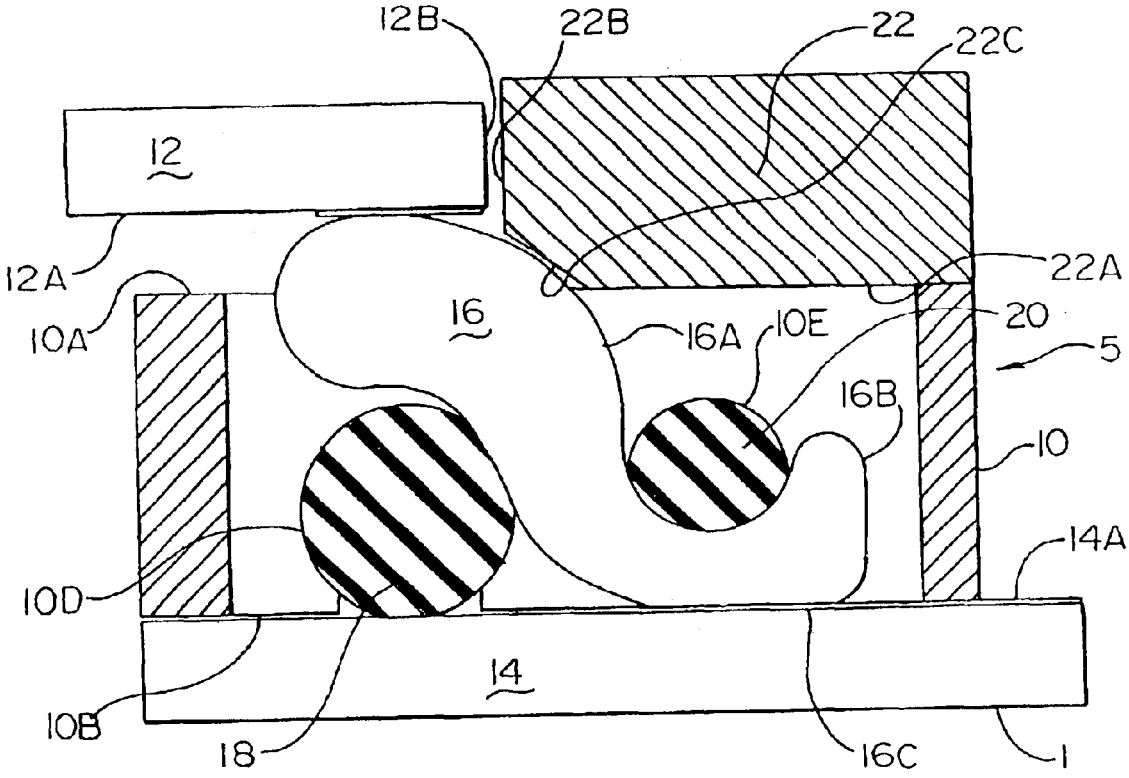
FIG. 2 is a cross-section view of the portions of FIG. 1 before electrical interconnection.
Figure 3:
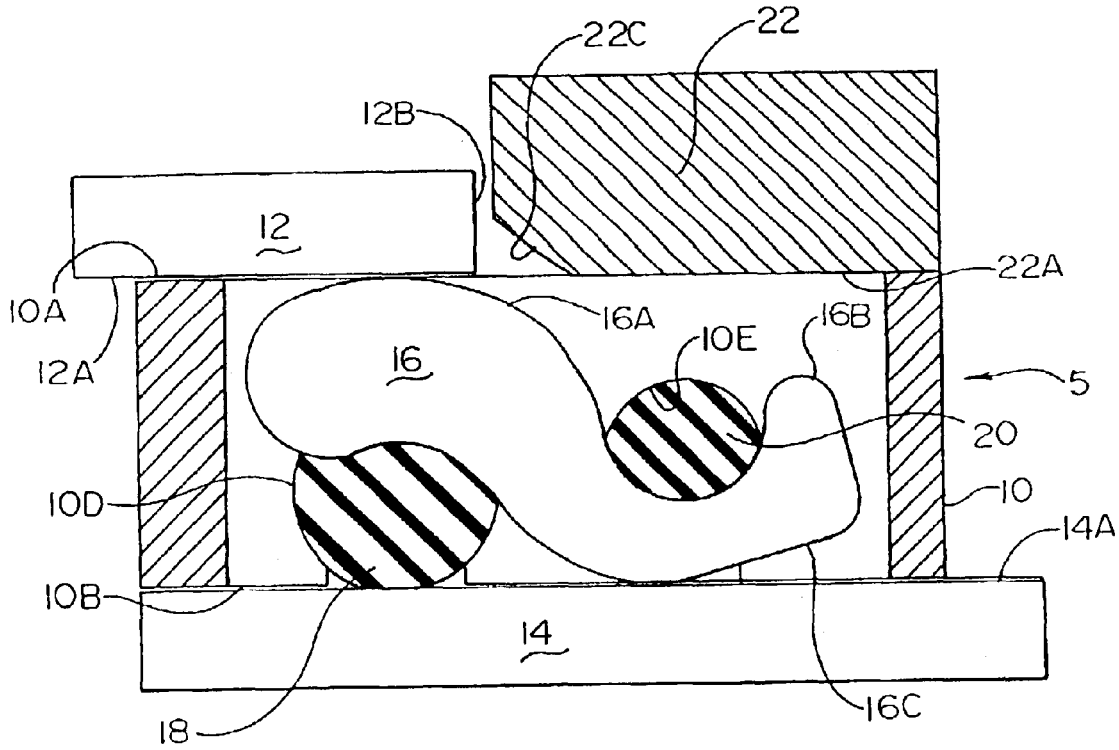
FIG. 3 is the cross-section view of the portions of FIG. 1 after electrical interconnection.

An assembly 5, shown in FIGS. 1, 2 and 3 is mounted in a block shaped housing 10 having at least one pair of opposed essentially planar and parallel sides 10A and 10B oriented essentially parallel to one another. Housing 10 is arranged to electrically connect an integrated circuit device 12 to test apparatus 14 located respectfully adjacent and opposite to planar sides 10A and 10B. Parallel spaced slots 10C extend through housing 10 between and perpendicular to sides 10A and 10B. Each slot 10C contains a pivotable contact 16.

Device 12 has a planar side 12A and a linear edge 12B perpendicular to the side. Side 12A contains exposed parallel leads, not shown, on the surface of the side spaced apart the same distance as the slots. The leads are located on the surface of side 12A adjacent to edge 12B and extend inward from edge 12B perpendicularly.

Test apparatus 14 has a planar side 14A containing exposed parallel terminals on the surface of the side, not shown, which are spaced apart the same distance as the slots.

Apparatus known in the art positions side 12A of device 12 near and parallel to side 10A of housing 10. Side 14A of apparatus 14 is located on side 14A of the housing. The leads of device 12 are located opposite and parallel to contacts 16, and the terminals of test apparatus 14 are located opposite and parallel to the opposite side of the respective contacts, with the leads and terminals being positioned toward opposite ends of the contacts. This arrangement permits the electrical connection and disconnection of the leads and terminals by rotating contacts 16 within slots 10C.

Contacts 16 are planar and have a nose end 16A and a tail end 16B which form essentially an "S" shape. Nose end 16A is larger than tail end 16B to provide an outward extension toward the leads of device 12. Tail end 16B has a flat portion 16C which is parallel to the planar side 10B of housing 10 before contacts 16 are rotated. This results in the pivot point being shifted during rotation of contact 16 such that the contact cannot lift out of the housing.

Cylindrical shaped front hole 10D and cylindrical shaped back hole 10E are offset from each other and extend completely through housing 10 perpendicular to slots 10C with hole 10D opposite the leads and hole 10E opposite the terminals. Hole 10D is larger than hole 10E. A cylindrical shaped front elastomeric member 18, which matches front hole 10D, extends through the front hole, and a cylindrical shaped back elastomeric member 20, which matches back hole 10E, extends through the back hole. The curved inner side of nose end 16A is shaped and located such that it essentially mates with and bears against the outer surface of front elastomeric member 18. The curved inner 20 side of tail end 16B is shaped and located such that it essentially mates with and bears against the outer surface of back elastomeric member 20.

Front hole 10D has a communicating channel 10F with parallel sides extending outward from the hole perpendicular to planar side 10B, and back hole 10E has a communicating channel 10G with parallel sides also extending outward perpendicularly to side 10B. The sides of channels 10F and 10G are spaced slightly closer together than the diameter of their respective communicating holes to require forcing front elastomeric member 18 and back elastomeric member 20 into their respective mating front hole 10D and back hole 10E such that they are retained in place. In another embodiment, channels 10F and 10G can be omitted, and elastomeric members 18 and 20 inserted and pressed into place from an outer end of their respective front hole 10F and back hole 10G.

Front elastomeric member 18 can be made of different elastomeric material than back elastomeric member 20. This use of different material for front elastomeric member 18 than for back elastomeric member 20, and the size difference allows a different force to be applied by nose end 16B than by tail end 16C.

In another embodiment, back elastomeric member 20 and hole 10E are both omitted, and the tail end 16B of contact 16 is not curved. In this arrangement, while tail ends 16B will still be forced against the terminals, the forces on each end of contact 16 cannot be tailored independently because of only one elastomer. Contact 16 will still rotate and predetermined forces will be applied by the nose end 16A and tail end 16B of the contact to respective opposite leads and terminals. All of the other elements remain the same.

An alignment plate 22 has a planar surface 22A with a linear edge 22B perpendicular to the surface. Edge 22B has a corner bevel 22C on the edge which faces contact 16. Plate 22 is attached across a portion of the surface 11A of housing 10 such that edge 22B is perpendicular to slots 10C and adjacent to device 12. Bevel 22C of alignment plate 22 limits the outward extension of contacts 16 to a desired predetermined amount. Alignment plate 22 also orients and positions edge 12B of device 12 such that leads 16 are parallel to contacts 18 and opposite to nose ends 16A of contact 16.

Prior to use device 12 is located adjacent to housing 10, in the position and orientation shown in FIG. 1 by apparatus known in the art. This apparatus is also used to move surface 12A of device 12 to contact surface 10A of housing 10, as shown in FIG. 2 such that each lead is parallel to and directly opposite from nose ends 16A of contacts 16, and such that each terminal is parallel and in contact with tail ends 16B of the contacts, as shown in FIG. 3. This movement forces the nose ends 16A of contacts 16 within slots 10D and rotates contacts 16. This rotation of contacts 16 results in nose end 16A compressing front elastomeric member 18 and tail end 16B compressing back elastomeric member 20. This rotation of contacts 16 also rotates the contact tail ends 16B flat portions 16C from their parallel relationship to the terminals.

Since the dimensions of the parts and the elastomeric material are selectable, the amount of force provided to compress the two elastomeric members can also be selected to provide a different force on the leads 16 then on the terminals. The predetermined force for each can be selected to be sufficient to provide a good electrical connection between the leads and terminals without excessive force on the small leads.

These embodiments are representative of what those skilled in the art can provide based upon the above teachings. The true scope of the invention is indicated by the following claims.

What is claimed is:

1. Apparatus for the temporary electrical interconnection of device leads to test apparatus terminals comprising:

(a) a housing with opposed planar and parallel first and second surfaces having parallel contact receiving slots extending therebetween with opposed first and second ends, the housing also having an essentially cylindrically shaped front hole and a smaller essentially cylindrically shaped back hole which extend through the housing perpendicular to the slots with the front hole being a predetermined distance closer to the first surface of the housing than the back hole and a predetermined distance closer to the first end of the slot than the back hole;

b) a cylindrical shaped front elastomeric member sized to fill the front hole, and a cylindrical shaped back elastomeric member sized to fill the back hole;

c) generally planar contacts having an inwardly curved nose end and an opposite inwardly curved tail end which together form an essentially "S" shape, being shaped and sized to rotatably fit within each slot being arranged such that when the first elastomeric member is positioned within the first hole and the second elastomeric member is positioned within the back hole and the contact is positioned within the slot in engagement with the first elastomeric member and the second elastomeric member, the nose end of the contact will be biased to extend outward past the first surface a predetermined distance and the nose end will essentially match and partially encircle the outermost surface of the front elastomeric member, and the tail end of the contact will extend outward to the second surface and the tail end will essentially match and partially encircle the outermost surface of the back elastomeric member, and such that, when a planar surface of a device is placed next to the first surface of the housing opposite the nose end of the contacts, the nose end of the contact will be forced into the slot even with the first surface to rotate the contact and compress the front and back elastomeric members; and further comprising an essentially rectangular shaped alignment plate having a parallel side and having a linear edge perpendicular thereto, the parallel side of the plate abutting the first surface of the housing such that the perpendicular edge is perpendicular to the slots, the plate being positioned and sized such as to allow portions of the first surface of the housing opposite the nose end of the contacts to remain uncovered, the edge of the plate being beveled on the lower corner with the dimensions being such that the beveled edge of the alignment plate will permit the nose end of the contact to extend outward only a predetermined distance above the first surface.

2. Apparatus as in claim 1 further comprising a first channel interconnected with and centered on the first hole and a second channel interconnected with and centered on the back hole, both channels extending outwardly from their respective holes perpendicularly to the second surface, and both having parallel sides spaced closer together than the diameter of their respective interconnected hole such that elastomeric members can be forced into their respective holes through their respective channels.

3. Apparatus as in claim 1 wherein the tail end of the contact has a linear surface located on the outer part of the curved portion arranged such that the linear surface will be parallel to a corresponding adjacent terminal of said test apparatus when the first and second elastomeric members are not compressed.

4. Apparatus as in claim 1 wherein the first and second elastomeric members are composed of different materials.

5. Apparatus for temporary electrical interconnections comprising:

(a) a housing having opposed planar and parallel first and second surfaces with parallel contact receiving slots extending therebetween which have opposed first and second ends, the housing also having an essentially cylindrically shaped hole which extends through the housing perpendicular to the slots with the hole being a predetermined distance from the first surface of the housing and a predetermined distance from the first end of the slot;

b) a cylindrical shaped elastomeric member sized to fill the hole;

c) generally planar contacts having an inwardly curved nose end, being shaped and sized to rotatably fit within each slot being arranged such that when the elastomeric member is positioned within the hole and the contact is positioned within the slot in engagement with the elastomeric member, the nose end of the contact will be biased to extend outward past the first surface a predetermined distance and the nose end will essentially match and partially encircle the outermost surface of the elastomeric member, and such that, when a planar surface of a device is placed next to the first surface of the housing, the nose end of the contact will be forced into the slot even with the first surface to rotate the contact and compress the elastomeric member; and further comprising an essentially rectangular shaped alignment plate having a parallel side and having a linear edge perpendicular thereto, the parallel side of the plate abutting the first surface of the housing such that the perpendicular edge is perpendicular to the slots, the plate being positioned and sized such as to allow portions of the first surface of the housing opposite the nose end of the contacts to remain uncovered, the edge of the plate being beveled on the lower corner with the dimensions being such that the beveled edge of the alignment plate will permit the nose end of the contact to extend outward only a predetermined distance above the first surface.

6. Apparatus as in claim 5 further comprising a channel interconnected with and centered on the hole, the channel extending outwardly from the holes perpendicular to the second surface, having parallel sides spaced closer together than the diameter of the hole such that the elastomeric member can be forced into the holes through the channel.

* * * * *